US006719441B2

(12) United States Patent
Wong

(10) Patent No.: US 6,719,441 B2
(45) Date of Patent: Apr. 13, 2004

(54) LIGHT BULB ASSEMBLY IN A LIGHT STRING WITH LIGHT BULBS EXTENDING OUT OF A CASING

(76) Inventor: Tsui-Tuan Fan Wong, 15th Fl., No. 81, Sec. 1, Hsintai 5th Rd., Hsitzu City, Taipei Hsien (TW)

( * ) Notice: Subject to any disclaimer, the term of this patent is extended or adjusted under 35 U.S.C. 154(b) by 0 days.

(21) Appl. No.: 10/197,540

(22) Filed: Jul. 17, 2002

(65) Prior Publication Data

US 2004/0012963 A1 Jan. 22, 2004

(51) Int. Cl.[7] ..... F21V 31/00; F21V 17/04
(52) U.S. Cl. ..... 362/267; 362/255; 362/351
(58) Field of Search ..... 362/226, 227, 362/249, 255, 267, 351

(56) References Cited

U.S. PATENT DOCUMENTS 4,376,966 A * 3/1983 Tieszen ..... 362/249
5,029,056 A * 7/1991 Patterson, Jr. ..... 362/226
5,428,518 A * 6/1995 Huang ..... 362/267
5,685,638 A * 11/1997 Huang ..... 362/267
6,250,782 B1 * 6/2001 Huang ..... 362/267

* cited by examiner

*Primary Examiner*—Alan Cariaso
(74) *Attorney, Agent, or Firm*—William E. Pelton, Esq.

(57) ABSTRACT

A light bulb assembly for a light string has a light bulb with two electrical wires extending out of the light bulb, a spacer positioned between the two electrical wires to separate the two electrical wires, two cables respectively connected to a corresponding one of the electrical wires, a membrane partially enclosing the light bulb, the electrical wires and a portion of the cables, and a casing enclosing the membrane, a portion of the light bulb, the electrical wires and the cables. The light bulb is able to emit its light through the casing and because of the membrane, water resistance of the light string structure is enhanced.

4 Claims, 3 Drawing Sheets

LIGHT BULB ASSEMBLY IN A LIGHT STRING WITH LIGHT BULBS EXTENDING OUT OF A CASING

BACKGROUND OF THE INVENTION

1. Field of the Invention

The present invention relates to a light bulb assembly for a light string, and more particularly to a light bulb assembly for a light string with a light bulb partially received in a casing so that each light bulb extends out to reveal light vividly.

2. Description of Related Art

Light string structures have been described in many patents to overcome different kinds of problems. Some patents discuss the use of a spacer to separate two electrical wires to accomplish the purpose of preventing water from seeping into the rope structure. Some patents discuss the use of a membrane to enclose the light bulb so that the light bulb is protected from the environment. However, no matter the spacer or the membrane is used, because the water resistance effectiveness by using the spacer is not as good as expected and using the membrane to protect the light bulb will hinder the decoration effect of the light bulb, the conventional existing rope structure has to be improved to enhance water resistance effectiveness, but also not hinder the decoration effect of the light bulbs of the light string.

To overcome the shortcomings, the present invention tends to provide an improved light bulb assembly to mitigate and obviate the aforementioned problems.

SUMMARY OF THE INVENTION

The primary objective of the present invention is to provide an improved light bulb assembly having a light bulb with two electrical wires extending out of the light bulb, a spacer positioned between the two electrical wires, two cables respectively connected to a corresponding one of the electrical wires, a membrane partially enclosing the light bulb and a casing enclosing the membrane, a portion of the light bulb, the electrical wires and the cables. With such an arrangement, the light bulb is able to emit its light through the casing and because of the membrane, water resistance of the light string structure is greatly increased.

Another objective of the present invention is that water resistant gel is inserted into the casing to allow the bulb, the spacer, the electrical wires and the cables to become an integral body.

Other objects, advantages and novel features of the invention will become more apparent from the following detailed description when taken in conjunction with the accompanying drawings.

DETAILED DESCRIPTION OF THE PREFERRED EMBODIMENT

Figure 1:
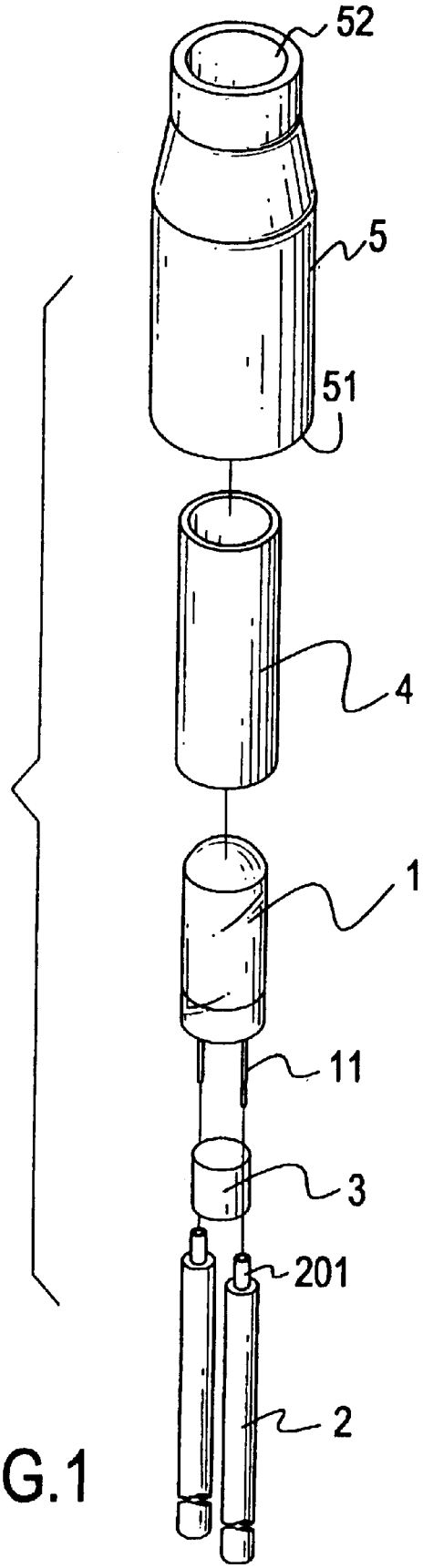
FIG. 1 is an exploded perspective view showing parts of the light bulb assembly of the present invention.

With reference to FIG. 1, the light bulb assembly for a light string and in accordance with the present invention has a light bulb (1) and provided with two electrical wires (11) extending out of the light bulb (1), a spacer (3) positioned between the two electrical wires (11), two cables (2) respectively connected to a corresponding one of the electrical wires (11), a membrane (4) partially enclosing tile light bulb (1) and a casing (5) enclosing the membrane (4), a portion of the light bulb (1), the electrical wires (11) and the cables (2).

Figure 2A:
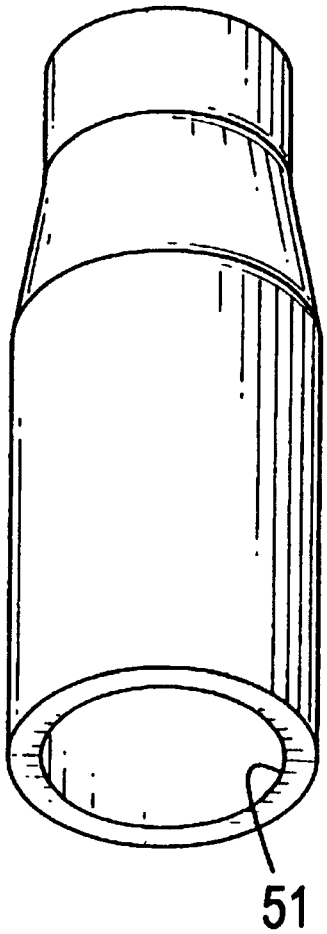
FIGS. 2A and 2B are perspective views showing the casing of the light bulb assembly of the present invention.
Figure 2B:
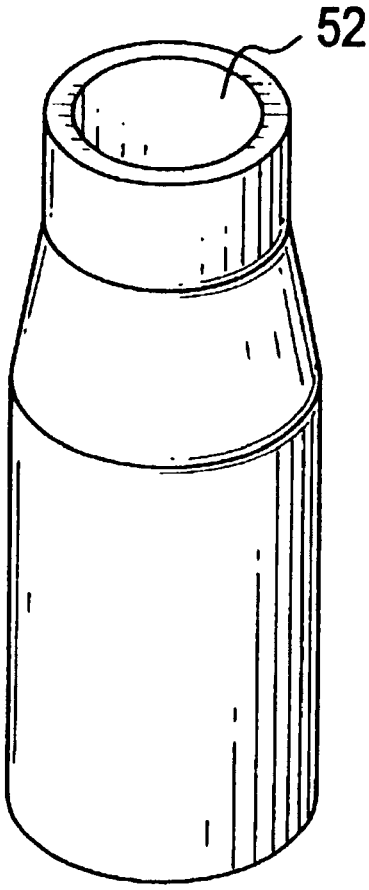
Figure 3:
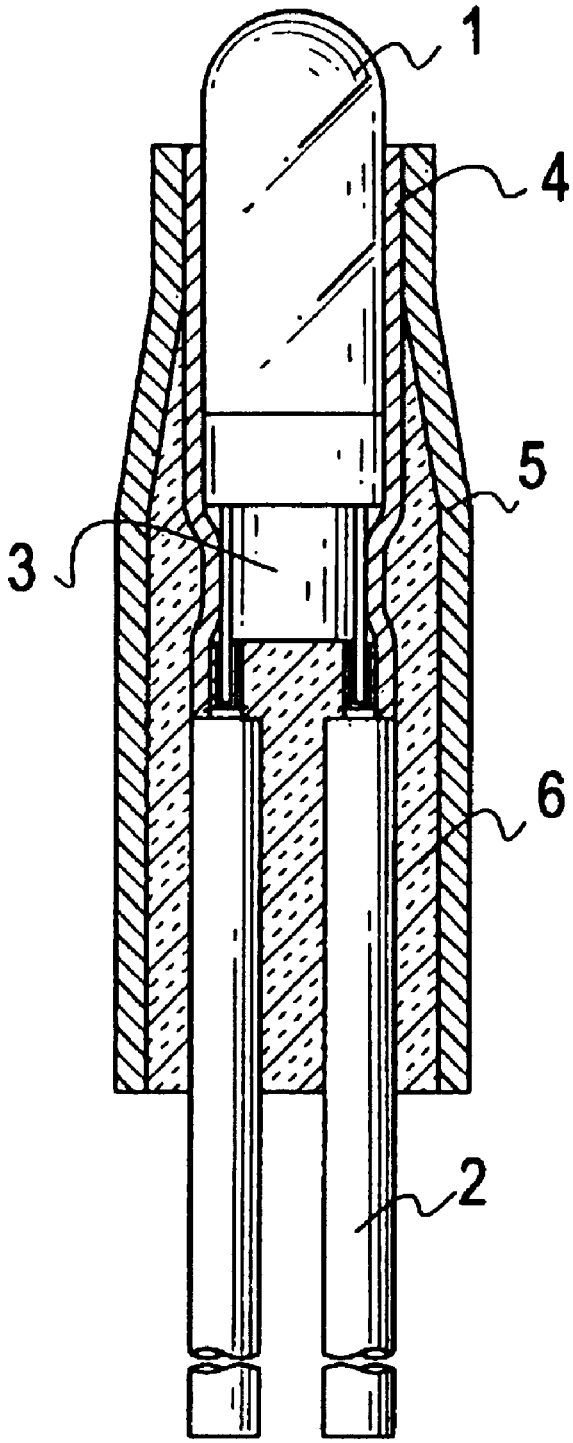
FIG. 3 is schematic view of the light string of the invention.

With reference to FIGS. 2A and 2B, it is noted that the casing (5) is hollow and conical in shape. A large opening (51) is defined in a bottom of the casing (5) and a small opening (52) is defined in a top of the casing (5). The light bulb (1) has a tapered diameter so that the light bulb has a smallest diameter and a largest diameter. The small opening (52) has a diameter slightly larger than the smallest diameter but smaller than the largest diameter of the light bulb (1).

When the parts in FIG. 1 are to be assembled, the spacer (3) is inserted between the electrical wires (11) and the cables (2) are respectively connected to the corresponding electrical wire (11). Then, the membrane (4) encloses a portion of the light bulb (1), the electrical wires (11) and a portion of the cables (2). Thereafter, the combination of the membrane (4), tile light bulb (1), the electrical wires (11) and the cables (2) are inserted into the casing (5) with the light bulb (1) partially extending through the small opening (52).

After the combination is inserted into the casing (5), a water resistant gel (6) is inserted into the casing (5) to allow the combination to become an integral body. With such an arrangement, the light bulb is able to emit its light through the casing (5) and because of the membrane (4) and the water resistant gel (6), water resistance of the light string structure is greatly increased.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A light bulb assembly for a light string, the light bulb assembly comprising:

a light bulb from which two electrical wires extend;

a spacer positioned between the two electrical wires to separate the two electrical wires;

two cables each of which is connected to one of said electrical wires;

a membrane enhancing water resistance of and partially enclosing the light bulb, the electrical wires and a portion of the cables; and a casing enclosing the membrane, a portion of the light bulb, the electrical wires and the cables, said casing being hollow and conical in shape and having a large bottom opening and a small top opening to permit light emitting from the light bulb to emit through the casing.

2. The light bulb assembly as claimed in claim 1 wherein the light bulb has a tapered diameter so as to have a smallest diameter which is slightly smaller than that of the small opening and a largest diameter larger than that of the large opening of the casing.

3. The light bulb as claimed in claim 1 further having a water resistant gel inserted into the hollow casing to allow the bulb, the spacer, the electrical wires, the membrane and the cables to become an integral body.

4. The light bulb as claimed in claim 2 further having a water resistant gel inserted into the hollow casing to allow the bulb, the spacer, the electrical wires, the membrane and the cables to become an integral body.

* * * * *